US006733843B2

(12) United States Patent
Tsukatani et al.

(10) Patent No.: US 6,733,843 B2
(45) **Date of Patent: *May 11, 2004**

(54) METHOD FOR THERMAL SPRAY COATING AND RARE EARTH OXIDE POWDER USED THEREFOR

(75) Inventors: Toshihiko Tsukatani, Fukui-ken (JP); Yasushi Takai, Fukui-ken (JP); Takao Maeda, Fukui-ken (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/423,903

(22) Filed: Apr. 28, 2003

(65) Prior Publication Data

US 2003/0203120 A1 Oct. 30, 2003

Related U.S. Application Data

(62) Division of application No. 09/893,565, filed on Jun. 29, 2001, now Pat. No. 6,576,354.

(30) Foreign Application Priority Data

| | | |
|---|---|---|
| Jun. 29, 2000 | (JP) | 2000-196037 |
| Mar. 8, 2001 | (JP) | 2001-064249 |
| Apr. 6, 2001 | (JP) | 2001-109099 |

(51) Int. Cl.[7] ..... C23C 4/10
(52) U.S. Cl. ..... 427/453; 427/455; 427/456
(58) Field of Search ..... 427/450, 452, 427/453, 455, 456

(56) References Cited

U.S. PATENT DOCUMENTS

| | | | | |
|---|---|---|---|---|
| 4,590,090 A | | 5/1986 | Siemers et al. | |
| 4,645,716 A | | 2/1987 | Harrington et al. | |
| 4,996,117 A | | 2/1991 | Chu et al. | |
| 5,061,560 A | | 10/1991 | Tajima et al. | |
| 6,447,937 B1 | * | 9/2002 | Murakawa et al. | 428/696 |
| 2002/0018921 A1 | * | 2/2002 | Yamada et al. | 428/697 |

FOREIGN PATENT DOCUMENTS

| | | | |
|---|---|---|---|
| EP | 167 723 A1 | * | 1/1986 |
| EP | 0 167 723 | | 1/1986 |
| EP | 0 990 713 | | 4/2000 |
| JP | 06-142822 | * | 5/1994 |

OTHER PUBLICATIONS

Metals Handbook, Ninth Edition, vol. 5: Surface Cleaning, Finishing, and Coating, American Society for Metals, 1982, p. 364.*

Patent Abstracts of Japan, vol. 018, No. 145 (C–1178), Mar. 10, 1994—Abstract of JP 05–320860.

* cited by examiner

*Primary Examiner*—Katherine A. Bareford
(74) *Attorney, Agent, or Firm*—Wenderoth, Lind & Ponack, L.L.P.

(57) ABSTRACT

The invention discloses an efficient method for the formation of a highly corrosion- or etching-resistant thermal spray coating layer of a rare earth oxide or rare earth-based composite oxide by a process of plasma thermal spray method by using a unique thermal spray powder consisting of granules of the oxide. The thermal spray granules are characterized by a specified average particle diameter of 5 to 80 $\mu$m with a specified dispersion index of 0.1 to 0.7 and a specified BET specific surface area of 1 to 5 $m^2/g$ as well as a very low content of impurity iron not exceeding 5 ppm by weight as oxide. The flame spat powder used here is characterized by several other granulometric parameters including globular particle configuration, particle diameter $D_{90}$, bulk density and cumulative pore volume.

5 Claims, No Drawings

METHOD FOR THERMAL SPRAY COATING AND RARE EARTH OXIDE POWDER USED THEREFOR

This is a divisional of Ser. No. 09/893,565, filed Jun. 29, 2001 now U.S. Pat. No. 6,576,354.

BACKGROUND OF THE INVENTION

The present invention relates to a novel method for thermal spray coating and a rare earth oxide powder used therefor or, more particularly, to a method for thermal spray coating capable of giving a highly heat-resistant, abrasion-resistant and corrosion-resistant coating layer on the surface of a variety of substrates and a rare earth oxide powder having unique granulometric parameters and suitable for use as a thermal spray coating material.

The method of so-called thermal spray coating utilizing a gas flame or plasma flame is a well established process for the formation of a coating layer having high heat resistance, abrasion resistance and corrosion resistance on the surface of a variety of substrate articles such as bodies made from metals, concrete, ceramics and the like, in which a powder to form the coating layer is ejected or sprayed as being carried by a flame at the substrate surface so that the particles are melted in the flame and deposited onto the substrate surface to form a coating layer solidified by subsequent cooling.

The powder to form the coating layer on the substrate surface by the thermal spray coating method, referred to as a thermal spray powder hereinafter, is prepared usually by melting a starting material in an electric furnace and solidifying the melt by cooling followed by crushing, pulverization and particle size classification to obtain a powder having a controlled particle size distribution suitable for use in process of thermal spray coating.

A typical industrial field in which the method of thermal spray coating is widely employed is the semiconductor device manufacturing process which in many cases involves a plasma etching or plasma cleaning process by using a chlorine- and/or fluorine-containing etching gas utilizing the high reactivity of the plasma atmosphere of the halogen-containing gas. Examples of the fluorine- and/or chlorine-containing gases used for plasma generation include $SF_6$, $CF_4$, $CHF_3$, $ClF_3$, HF, $Cl_2$, $BCl_3$ and HCl either singly or as a mixture of two kinds or more. Plasma is generated when microwaves or high-frequency waves are introduced into the atmosphere of these halogen-containing gases. It is therefore important that the surfaces of the apparatus exposed to these halogen-containing gases or plasma thereof are highly corrosion-resistant. In the prior art, members or parts of such an apparatus are made from or coated by thermal spray coating with various ceramic materials such as silica, alumina, silicon nitride, aluminum nitride and the like in consideration of their good corrosion resistance.

Usually, the above mentioned ceramic materials are used in the form of a thermal spray powder prepared by melting, solidification, pulverization and particle size classification of the base ceramic material as a feed to a gas thermal spray or plasma thermal spray coating apparatus. It is important here that the particles of the thermal spray powder are fully melted within the gas flame or plasma flame in order to ensure high bonding strength of the thermal spray coating layer to the substrate surface.

It is also important here that the thermal spray powder has good flowability in order not to cause clogging of the feed tubes for transportation of the powder from a powder reservoir to a thermal spray gun or the spray nozzle because smoothness of the powder feeding rate is a very important factor affecting the quality of the coating layer formed by the thermal spray coating method in respect of the heat resistance, abrasion resistance and corrosion resistance. In this regard, the thermal spray powders used in the prior art are generally unsatisfactory because the particles have irregular particle configurations resulting in poor flowability with a large angle of repose so that the feed rate of the powder to the thermal spray gun cannot be increased as desired without causing clogging of the spray nozzle so that the coating process cannot be conducted smoothly and continuously greatly affecting the productivity of the process and quality of the coating layer.

With an object to obtain a thermal spray coating layer having increased denseness and higher hardness, furthermore, a method of reduced-pressure plasma thermal spray coating is recently proposed in which the velocity of thermal spraying can be increased but the plasma flame is necessarily expanded in length and cross section with a decreased energy density of the plasma flame so that, unless the thermal spray powder used therein has a decreased average particle diameter, full melting of the particles in the flame cannot be accomplished. While a thermal spray powder having a very small average particle diameter is prepared, as is mentioned above, by melting the starting material, solidification of the melt, pulverization of the solidified material and particle size classification, the last step of particle size classification by screening can be conducted only difficulties when the average particle diameter of the powder is already very small.

While in the prior art, many of the parts or members of a semiconductor-processing apparatus are made from a glassy material or fused silica glass, these materials have only low corrosion resistance against a plasma atmosphere of a halogen-containing gas resulting not only rapid wearing of the apparatus but also a decrease in the quality of the semiconductor products as a consequence of surface corrosion of the apparatus by the halogen-containing plasma atmosphere.

Although ceramic materials such as alumina, aluminum nitride and silicon carbide are more resistant than the above mentioned glassy materials against corrosion in a plasma atmosphere of a halogen-containing gas, a coating layer of these ceramic materials formed by the method of thermal spray coating is not free from the problem of corrosion especially at an elevated temperature so that semiconductor-processing apparatuses made from or coated with these ceramic materials have the same disadvantages as mentioned above even if not so serious.

SUMMARY OF THE INVENTION

The present invention accordingly has an object, in order to overcome the above described problems and disadvantages in the prior art methods of thermal spray coating, to provide a novel and improved method of thermal spray coating which can be conducted at a high productivity of the process by using a thermal spray powder having excellent flowability in feeding and good fusibility in the flame and capable of giving a coating layer with high corrosion resistance against a halogen-containing gas or a plasma atmosphere of a halogen-containing gas even at an elevated temperature.

Thus, the present invention provides a method for the formation of a highly corrosion-resistant coating layer on the surface of a substrate by thermal spray coating, which comprises the step of: spraying particles of a rare earth oxide or a rare earth-based composite oxide, in which the impurity content of an iron group element or, in particular, iron does not exceed 5 ppm by weight calculated as oxide, at the substrate surface as being carried by a flame or, in particular, plasma flame to deposit a melt of the particles onto the substrate surface forming a layer. It is further desirable that the contents of alkali metal elements and alkaline earth metal elements as impurities in the rare earth oxide-based thermal spray powder each does not exceed 5 ppm by weight calculated as the respective oxides.

In particular, the particles of the rare earth oxide or rare earth-based composite oxide have an average particle diameter in the range from 5 to 80 $\mu$m with a dispersion index in the range from 0.1 to 0.7 and a specific surface area in the range from 1 to 5 $m^2/g$. More particularly, the particles are preferably granules of a globular configuration obtained by granulation of primary particles of the oxide having an average particle diameter in the range from 0.05 to 10 $\mu$m.

It is more desirable that the above described rare earth oxide-based thermal spray powder has the granulometric characteristics including;

- a globular particle configuration with an aspect ratio of the particles not exceeding 2;
- a particle diameter $D_{90}$ at 90% by weight level in the particle diameter distribution not exceeding 60 $\mu$m;
- a bulk density not exceeding 1.6 $g/cm^3$; and
- a cumulative pore volume of at least 0.02 $cm^3/g$ for the pores having a pore radius not exceeding 1 $\mu$m.

DETAILED DESCRIPTION OF THE PREFERRED EMBODIMENTS

The thermal spray powder used in the inventive method of thermal spray coating consists of particles of an oxide of a rare earth element or a composite oxide of a rare earth element and another element such as aluminum, silicon and zirconium. It is essential that the impurity content of iron group elements. i.e. iron, cobalt and nickel, in the powder does not exceed 5 ppm by weight calculated as oxide. The particles of the thermal spray powder, which are preferably granulated particles, should preferably have specified values of several granulometric parameters including the average particle diameter, dispersion index for the particle diameter distribution, globular particle configuration defined in terms of the aspect ratio of particles, bulk density, pore volume and specific surface area as obtained by granulation of primary particles of the oxide having a specified average particle diameter.

When a thermal spray powder satisfying the above mentioned various requirements is used in the inventive method, the coating layer of the rare earth oxide or rare earth-based composite oxide has very desirable properties of high heat resistance, abrasion resistance and corrosion resistance as well as in respect of uniformity of the coating layer and adhesion of the coating layer to the substrate surface if not to mention the greatly improved productivity of the coating process by virtue of the good flowability of the powder in feeding to the spray gun. When the content of iron impurity in the powder is too high, for example, it is a possible case that the iron impurity is locally concentrated to form speckles where iron reacts with the rare earth element to cause localized corrosion of the coating layer in an atmosphere of a halogen-containing gas or plasma thereof.

The above mentioned very low impurity content of the iron group elements can be accomplished by using a high-purity starting oxide material and conducting the granulation process of the starting oxide powder in an atmosphere of a high-class clean room in order to avoid entering of iron-containing dust into the oxide powder from the ambience.

The thermal spray powder used in the inventive method is not limited to an oxide or composite oxide of the rare earth element but can be a carbide, boride or nitride of the rare earth element although oxides are preferable in respect of the excellent chemical stability in an atmosphere of a halogen-containing gas or plasma thereof.

The rare earth element, of which a powder of oxide or composite oxide is employed as the thermal spray powder in the inventive method, includes yttrium and the elements having an atomic number in the range from 57 to 71, of which yttrium, europium, gadolinium, terbium, dysprosium, holmium, erbium, thulium, ytterbium and lutetium are preferable and yttrium, gadolinium, dysprosium, erbium and ytterbium are more preferable. These rare earth elements can be used either singly or as a combination of two kinds or more. The composite oxide of a rare earth element is formed from a rare earth element and a composite-forming element selected from aluminum, silicon and zirconium or, preferably, from aluminum and silicon. The chemical form of the composite oxide includes those expressed by the formulas $RAlO_3$, $R_4Al_2O_9$, $R_3Al_5O_{12}$, $R_2SiO_5$, $R_2Si_2O_7$, $R_2Zr_2O_7$ and the like, in which R is a rare earth element, though not particularly limitative thereto. A mixture of a rare earth oxide powder and an oxide powder of aluminum, silicon and/or zirconium can also be used as an equivalent to the composite oxide powder since a composite oxide can be formed in the flame from the oxides when melted.

It is important that primary particles of a rare earth oxide or a rare earth-based composite oxide are granulated into granules having an average diameter in the range from 5 to 80 $\mu$m or, preferably, from 20 to 80 $\mu$m for use as a thermal spray powder having good flowability. Oxide granules having an average diameter smaller than 5 $\mu$m are disadvantageous due to the difficulties encountered in the process of granulation while, when the average diameter of the granules is too large, fusion of the granules in the spraying flame is sometimes incomplete to leave the core portion of the granules unmelted resulting in a decrease of the adhesion of the coating layer to the substrate surface and decreased utilizability of the thermal spray powder.

It is also important that the granulated particles of the thermal spray powder have a particle diameter distribution as narrow as possible because, when the powder having a broad particle diameter distribution is exposed to a high temperature flame such as plasma flame, granules having a very small diameter are readily melted eventually to be lost by evaporation while granules having a great diameter are melted only incompletely leading to failure of deposition of the melt on the substrate surface resulting in the loss of the thermal spray powder. A problem in a thermal spray powder of a narrow particle size distribution is that the preparation process thereof is complicated not to be suitable for mass production of the powder. Thermal spray powders having a broad particle size distribution generally have poor flowability to cause clogging of the feed tubes and spray nozzles. In this regard, the thermal spray powder should have an appropriate value of dispersion index in the range from 0.1 to 0.7 for the particle diameter distribution. The dispersion index mentioned above is a value defined in terms of the equation:

$$\text{Dispersion index}=(D_{90}-D_{10})/(D_{90}+D_{10}),$$

in which $D_{90}$ and $D_{10}$ are each such an upper limit particle diameter that 90% by weight or 10% by weight, respectively, of the particles constituting the powder have a diameter smaller than $D_{90}$ and $D_{10}$, respectively.

Since the thermal spray powder consists of granules of a relatively large average particle diameter as prepared by granulation of fine primary particles, the specific surface area of the granules can be relatively large for the relatively large particle diameter so as to ensure good fusing behavior in the thermal spray fusion. In consideration of the balance between advantages and disadvantages, the thermal spray powder used in the inventive method should desirably have a specific surface area in the range from 1 to 5 $m^2/g$ as measured by the BET method. When the specific surface area of the powder is too small, the efficiency of heat transfer to the granules in thermal spray fusion cannot be high enough resulting in occurrence of unevenness in the coating layer. On the other hand, a too large specific surface area of the granules means an undue fineness of the primary particles to cause inconvenience in handling of the powder.

In consideration of the above mentioned various requirements for the granules, the primary particles, from which the granules are prepared by granulation, of the rare earth oxide or rare earth-based composite oxide should have an average particle diameter in the range from 0.05 to 10 $\mu$m or, preferably, from 0.5 to 10 $\mu$m.

In addition to the above described several requirements, it is more desirable that the particles or granules of the thermal spray powder in the present invention satisfy various other granulometric characteristics including:

- a globular particle configuration with an aspect ratio of the particles not exceeding 2;
- a particle diameter $D_{90}$ at 90% by weight level in the particle diameter distribution not exceeding 60 $\mu$m;
- a bulk density not exceeding 1.6 $g/cm^3$; and
- a cumulative pore volume of at least 0.02 $cm^3/g$ for the pores having a pore radius not exceeding 1 $\mu$m.

The above mentioned aspect ratio of the particles, by which the globular configuration of the particles is defined, is the ratio of the largest diameter to the smallest diameter of the particles. This value can be determined from a scanning electron microscopic photograph of the particles. An aspect ratio of 1 corresponds to a true spherical particle configuration and a value thereof larger than 2.0 represents an elongated particle configuration. When the aspect ratio of the particles or granules exceeds 2.0, the powder hardly exhibits good flowability. In this regard, the aspect ratio should be as small as possible to be close to 1.

The $D_{90}$ value in the particle diameter distribution of the particles or granules should be 60 $\mu$m or smaller or, preferably, in the range from 20 to 60 $\mu$m or, more preferably, in the range from 25 to 50 $\mu$m. When this value is too large, fusion of the particles is sometimes incomplete in thermal spray coating resulting in a rugged surface of the flame-fusion coating film on the substrate surface. When the thermal spray powder consists of granules prepared by using an organic binder, thermal decomposition of the binder resin is eventually incomplete in a large granule leaving a carbonaceous decomposition product in the coating film as a contaminant.

The bulk density and the cumulative pore volume of the particles or granules are also parameters affecting the fusing behavior of the powder in thermal spray coating. In this regard, the bulk density of the particles should be 1.6 $g/cm^3$ or smaller and the cumulative pore volume should be 0.02 $cm^3/g$ or larger or, preferably, in the range from 0.03 to 0.40 $cm^3/g$. When the bulk density is too large or the cumulative pore volume is too small, thermal spray fusion of the granules is sometimes incomplete resulting in degradation of the thermal spray coating films.

A typical procedure for granulation of the above described primary particles is as follows. Thus, the powder of primary particles is admixed with a solvent such as water and alcohol containing a binder resin to give a slurry which is fed to a suitable granulator machine such as rotary granulators, spray granulators, compression granulators and fluidization granulators to be converted into globular granules as an agglomerate of the primary particles, which are, after drying, subjected to calcination in atmospheric air for 1 to 10 hours at a temperature in the range from 1200 to 1800° C. or, preferably, from 1500 to 1700° C. to give a thermal spray powder consisting of globular granules having an average diameter of 5 to 80 $\mu$m.

When granules of a rare earth-based composite oxide are desired as the thermal spray powder, it is of course a possible way that primary particles of the rare earth-based composite oxide are subjected to the above described procedure of granulation. Alternatively, it is also possible to employ, instead of the primary particles of the composite oxide, a mixture of primary particles of a rare earth oxide and a composite-forming oxide such as alumina, silica and zirconia in a stoichiometric proportion corresponding to the chemical composition of the composite oxide. When granules of a rare earth aluminum garnet of the formula $R_3Al_5O_{12}$ are desired, for example, primary particles of the rare earth aluminum garnet can be replaced with a mixture of the rare earth oxide $R_2O_3$ particles and alumina $Al_2O_3$ particles in a molar ratio of 3:5.

Examples of the binder resin used in the granulation of the primary oxide particles into granules include polyvinyl alcohol, cellulose derivatives, e.g., carboxymethyl cellulose, hydroxypropylcellulose and methylcellulose, polyvinyl pyrrolidone, polyethyleneglycol, polytetrafluoroethylene resins, phenol resins and epoxy resins, though not particularly limitative thereto. The amount of the binder resin used for granulation is in the range from 0.1 to 5% by weight based on the amount of the primary oxide particles.

The process of thermal spray coating by using the above described oxide granules is conducted preferably by way of plasma thermal spraying or reduced-pressure plasma thermal spraying by using a gas of argon or nitrogen or a gaseous mixture of nitrogen and hydrogen, argon and hydrogen, argon and helium or argon and nitrogen, though not particularly limitative thereto.

The method of thermal spray coating according to the invention is applicable to a variety of substrates of any materials without particular limitations. Examples of applicable materials of substrates include metals and alloys such as aluminum, nickel, chromium, zinc and zirconium as well as alloys of these metals, ceramic materials such as alumina, zirconia, aluminum nitride, silicon nitride and silicon carbide, and fused silica glass. The thickness of the coating layer formed by the thermal spray coating method is usually in the range from 50 to 500 $\mu$m depending on the intended application of the coated articles. Members and parts of a semiconductor processing apparatus exhibiting high performance can be obtained by coating according to the inventive method.

Since the thermal spray powder used in the inventive method consists of globular granules of fine primary particles of the oxide, the powder can be smoothly sprayed into the flame without clogging of the spray nozzles and the granules can be melted in the plasma flame with high efficiency of heat transfer so that the coating layer formed by the method has a very uniform and dense structure. The impurity limitation of the thermal spray powder that the content of the iron group elements does not exceed 5 ppm by weight as oxides is particularly important for obtaining a coating layer free from localized corrosion even against the plasma of a halogen-containing etching gas sometimes encountered in a semiconductor processing apparatus. The thermal spray coated layer according to the present invention can be imparted with still improved quality when the thermal spray powder contains alkali metal elements and alkaline earth metal elements as impurities each group in an amount not exceeding 5 ppm by weight calculated as oxides.

In the following, the method of the present invention for thermal spray coating is described in more detail by way of Examples and Comparative Examples, which, however, never limit the scope of the invention in any way. In the Examples below, the values of particle size distribution $D_{10}$, $D_{50}$ and $D_{90}$ were determined by using an instrument Microtrac Particle Size Analyzer Model 9220 FRA.

EXAMPLE 1

An aqueous slurry of yttrium oxide particles was prepared by dispersing, in 15 liters of water containing 15 g of a polyvinyl alcohol dissolved therein, 5 kg of yttrium oxide particles having an average particle diameter of 1.1 μm and containing iron impurity in an amount not exceeding 0.5 ppm by weight calculated as $Fe_2O_3$. This slurry was subjected to granulation by spraying into and drying in a spray granulator equipped with a two-fluid nozzle into globular granules which were calcined in atmospheric air for 2 hours at 1700° C. to give a thermal spray powder of globular granules of yttrium oxide.

The thus obtained granules of yttrium oxide had an average particle diameter of 38 μm as measured by a laser-diffraction granulometric instrument and the dispersion index of the particle diameter distribution was 0.57 as calculated from the granulometric data. The granules had a specific surface area of 1.5 $m^2/g$ as determined by the BET method. A small portion of the granules was dissolved in an acid and the acid solution was analyzed for the content of $Fe_2O_3$ impurity by the ICP spectrophotometric method to find that the $Fe_2O_3$ content in the granules was 1 ppm by weight.

A coating layer of yttrium oxide having a thickness of 210 μm was formed on an aluminum alloy plate as the substrate using the above prepared yttrium oxide granules as the thermal spray powder in a reduced-pressure plasma thermal spray method with a gaseous mixture of argon and hydrogen as the plasma gas. No troubles were encountered during the coating process due to clogging of the spray nozzle and the utilizability of the thermal spray powder was as high as 40%.

The yttrium oxide-coated aluminum alloy plate was subjected to an evaluation test for the corrosion resistance by exposure for 16 hours to a carbon tetrafluoride plasma in a reactive ion-etching instrument to find that the etching rate was 2 nm/minute as determined by measuring the level difference on a laser microscope between the area exposed to the plasma atmosphere and the area protected against the attack of the plasma atmosphere by attaching a polyimide tape for masking. The above given experimental data are summarized in Table 1 below.

EXAMPLE 2

An aqueous slurry of ytterbium oxide particles was prepared by dispersing, in 15 liters of water containing 15 g of a carboxymethyl cellulose dissolved therein, 5 kg of yttrium oxide particles having an average particle diameter of 1.2 μm and containing iron impurity in an amount not exceeding 0.5 ppm by weight calculated as $Fe_2O_3$. This slurry was subjected to granulation by spraying into and drying in a spray granulator equipped with a two-fluid nozzle into globular granules which were calcined in atmospheric air for 2 hours at 1500° C. to give a thermal spray powder of globular granules of ytterbium oxide.

A coating layer of ytterbium oxide having a thickness of 230 μm was formed on an aluminum alloy substrate in the same manner as in Example 1. No troubles due to clogging of the spray nozzle were encountered during the coating procedure and the utilizability of the thermal spray powder was 45%. The etching rate of the ytterbium oxide coating layer determined in the same manner as in Example 1 was 2 nm/minute. These experimental data are summarized in Table 1 below.

EXAMPLE 3

The procedure for the preparation of granules of ytterbium oxide was substantially the same as in Example 2 described above excepting for the use of a rotary disk spray granulator instead of the two-fluid nozzle spray granulator. The granules had an average particle diameter of 65 μm with a dispersion index of 0.62 and a BET specific surface area of 1.1 $m^2/g$. The content of iron impurity in the granules was 3 ppm by weight as $Fe_2O_3$ by the ICP spectrophotometric analysis. A thermal spray coating layer of ytterbium oxide having a thickness of 200 μm was formed on an aluminum alloy substrate by using the granules in substantially the same manner as in Example 2 without any troubles due to clogging of the spray nozzles. The utilizability of the granules was 41%. The corrosion resistance of the coating layer was evaluated by determining the etching rate in the same manner as in Example 1 to find a value of 2 nm/minute. These experimental data are summarized in Table 1.

EXAMPLE 4

An aqueous slurry of dysprosium oxide particles was prepared by dispersing 5 kg of dysprosium oxide particles having an average particle diameter of 1.3 μm, of which the content of iron impurity did not exceed 0.5 ppm by weight as $Fe_2O_3$, in 15 liters of water containing 15 g of a polyvinyl alcohol dissolved therein and the aqueous slurry was spray-dried in a rotary disk spray granulator into globular granules which were subjected to a calcination treatment in air for 2 hours at 1400° C. to give dysprosium oxide granules as a thermal spray powder of dysprosium oxide.

The granules had an average particle diameter of 25 μm with a dispersion index of 0.68 and a BET specific surface area of 2.0 $m^2/g$. The content of iron impurity in the granules was 2 ppm by weight as $Fe_2O_3$ by the ICP spectrophotometric analysis. A thermal spray coating layer of dysprosium oxide having a thickness of 230 μm was formed on an aluminum alloy substrate by using the granules in substantially the same manner as in Example 2 without any troubles due to clogging of the spray nozzles. The utilizability of the granules was 52%. The corrosion resistance of the coating layer was evaluated by determining the etching rate in the same manner as in Example 1 to find a value of 3 nm/minute. These experimental data are summarized in Table 1.

EXAMPLE 5

An aqueous slurry of yttrium aluminum garnet (YAG) particles was prepared by dispersing 5 kg of YAG particles having an average particle diameter of 1.3 μm, of which the content of iron impurity did not exceed 0.5 ppm by weight as $Fe_2O_3$, in 15 liters of water containing 15 g of a polyvinyl alcohol dissolved therein. After passing a magnetic iron remover to decrease the iron impurity, the slurry was spray-dried in a two-fluid nozzle spray granulator into globular granules which were subjected to a calcination treatment in air for 2 hours at 1700° C. to give YAG granules as a thermal spray powder.

The granules had an average particle diameter of 32 μm as determined with a laser diffraction granulometric instrument with a dispersion index of 0.52 and a BET specific surface area of 2.1 $m^2/g$. The content of iron impurity in the granules was 1 ppm by weight as $Fe_2O_3$ by the ICP spectrophotometric analysis. A thermal spray coating layer of YAG having a thickness of 210 μm was formed on an aluminum alloy substrate by using the granules in substantially the same manner as in Example 2 without any troubles due to clogging of the spray nozzles. The utilizability of the granules was 52%. The corrosion resistance of the coating layer was evaluated by determining the etching rate in the same manner as in Example 1 to find a value of 2 nm/minute. These experimental data are summarized in Table 1.

EXAMPLE 6

The procedure for the preparation of a thermal spray powder of ytterbium silicate $Yb_2SiO_5$ in the form of globular granules was substantially the same as in Example 5 excepting for the replacement of the YAG particles with the same amount of ytterbium silicate particles having an average particle diameter of 1.5 μm, of which the content of iron impurity did not exceed 0.5 ppm by weight as $Fe_2O_3$.

The granules had an average particle diameter of 40 μm as determined with a laser diffraction granulometric instrument with a dispersion index of 0.60 and a BET specific surface area of 1.3 $m^2/g$. The content of iron impurity in the granules was 3 ppm by weight as $Fe_2O_3$ by the ICP spectrophotometric analysis. A thermal spray coating layer of ytterbium silicate having a thickness of 210 μm was formed on an aluminum alloy substrate by using the granules in substantially the same manner as in Example 2 without any troubles due to clogging of the spray nozzles. The utilizability of the granules was 60%. The corrosion resistance of the coating layer was evaluated by determining the etching rate in the same manner as in Example 1 to find a value of 2 nm/minute. These experimental data are summarized in Table 1.

COMPARATIVE EXAMPLE 1

The procedure for the preparation of yttrium oxide granules as a thermal spray powder was substantially the same as in Example 1 except that the starting yttrium oxide particles had an average particle diameter of 0.9 μm and the content of iron impurity therein was 10 ppm by weight as $Fe_2O_3$.

The granules had an average particle diameter of 45 μm with a dispersion index of 0.60 and a BET specific surface area of 2.0 $m^2/g$. The content of iron impurity in the granules was 12 ppm by weight as $Fe_2O_3$. A thermal spray coating layer of yttrium oxide having a thickness of 210 μm was formed on an aluminum alloy substrate by using the granules in substantially the same manner as in Example 1 without any troubles due to clogging of the nozzles. The utilizability of the granules was 35%. The corrosion resistance of the coating layer was evaluated by determining the etching rate in the same manner as in Example 1 to find a value of 320 nm/minute. These experimental data are summarized in Table 1. The above mentioned high value of the etching rate was presumably due to the fact that the coating layer had brown speckles indicating localized concentration of the iron impurity and measurement of the etching rate was conducted on the speckled areas.

COMPARATIVE EXAMPLE 2

A thermal spray powder of yttrium oxide particles was prepared by crushing and pulverizing a solidified melt of yttrium oxide particles having an average particle diameter of 4 μm followed by particle size classification. The thus prepared yttrium oxide particles had an average particle diameter of 36 μm with a dispersion index of 0.61. The content of iron impurity therein was 55 ppm by weight as $Fe_2O_3$.

A thermal spray coating layer of yttrium oxide having a thickness of 190 μm was formed on an aluminum alloy substrate by using the particles in substantially the same manner as in Example 1 without any troubles due to clogging of the spray nozzles. The utilizability of the powder was 11%. The corrosion resistance of the coating layer was evaluated by determining the etching rate in the same manner as in Example 1 to find a value of 430 nm/minute. These experimental data are summarized in Table 1. The above mentioned high value of the etching rate was presumably due to the fact that the coating layer had brown speckles indicating localized concentration of the iron impurity and measurement of the etching rate was conducted on the speckled areas.

COMPARATIVE EXAMPLES 3 to 6

The procedure for the preparation of a thermal spray powder in the form of granules in each of these COMPARATIVE EXAMPLES was substantially the same as in Example 1 excepting for the replacement of the yttrium oxide particles with particles of alumina, silica, silicon carbide and silicon nitride in COMPARATIVE EXAMPLES 3, 4, 5 and 6, respectively. Table 1 below shows the average particle diameter and dispersion index thereof and BET specific surface area for each of the thermal spray powders. A thermal spray coating layer was formed in the same manner as in Example 1 by using the thermal spray powders without any troubles due to clogging of the spray nozzles. Table 1 also shows the utilizability of the thermal spray powder in the thermal spray coating procedure and the etching rate of the coating layer measured in the same manner as in Example 1 in each of these Comparative Examples.

TABLE 1

| | Coating | Average particle diameter, μm | Dispersion index | Specific surface area, $m^2/g$ | $Fe_2O_3$, ppm | Utilizability, % | Etching rate, nm/minute |
|---|---|---|---|---|---|---|---|
| Example | | | | | | | |
| 1 | $Y_2O_3$ | 38 | 0.57 | 1.5 | 1 | 40 | 2 |
| 2 | $Yb_2O_3$ | 46 | 0.70 | 1.8 | 1 | 45 | 2 |
| 3 | $Yb_2O_3$ | 65 | 0.62 | 1.1 | 3 | 41 | 2 |

TABLE 1-continued

| | Coating | Average particle diameter, μm | Dispersion index | Specific surface area, $m^2/g$ | $Fe_2O_3$, ppm | Utilizability, % | Etching rate, nm/minute |
|---|---|---|---|---|---|---|---|
| 4 | $Dy_2O_3$ | 25 | 0.68 | 2.0 | 2 | 52 | 3 |
| 5 | $Y_3Al_5O_{12}$ | 32 | 0.57 | 2.1 | 1 | 52 | 2 |
| 6 | $Yb_2SiO_5$ | 40 | 0.60 | 1.3 | 3 | 60 | 2 |
| Comparative Example | | | | | | | |
| 1 | $Y_2O_3$ | 45 | 0.60 | 2.0 | 12 | 35 | 320 |
| 2 | $Y_2O_3$ | 36 | 0.61 | 0.1 | 55 | 11 | 430 |
| 3 | $Al_2O_3$ | 60 | 0.47 | 1.6 | — | 35 | 20 |
| 4 | $SiO_2$ | 43 | 0.49 | 2.5 | — | 32 | 88 |
| 5 | SiC | 72 | 0.50 | 3.5 | — | 42 | 143 |
| 6 | $Si_3N_4$ | 51 | 0.60 | 1.8 | — | 29 | 76 |

EXAMPLE 7

An aqueous slurry of yttrium oxide particles was prepared by dispersing 4 kg of yttrium oxide particles having an average particle diameter of 1.1 μm and containing 0.5 pp, or less of iron impurity as $Fe_2O_3$ in an aqueous solution of 15 g of polyvinyl alcohol dissolved in 16 liters of pure water under agitation. The aqueous slurry was subjected to granulation of yttrium oxide particles in a spray granulator into granules of a globular particle configuration which were calcined in air at 1600° C. for 2 hours to give globular granules usable as a thermal spray powder.

The thus obtained thermal spray powder was subjected to the measurement of the $D_{90}$ value by using a laser-diffraction particle size tester to find a value of 38 μm. The powder had a bulk density of 1.16 $g/cm^3$, BET specific surface area of 1.2 $m^2/g$, cumulative pore volume of 0.19 $cm^3/g$ for the pores having a pore radius not exceeding 1 μm and aspect ratio of granules of 1.10.

Impurities in the powder were determined by the ICP spectrophotometric analysis for iron and calcium and by atomic absorption spectrophotometric analysis for sodium to find 3 ppm of $Fe_2O_3$, 3 ppm of CaO and 4 ppm of $Na_2O$.

A thermal spray coating layer having a thickness of 160 μm was formed on a plate of an aluminum alloy with this thermal spray powder by the method of reduced-pressure plasma spray fusion using a gaseous mixture of argon and hydrogen. Clogging of the thermal spray nozzle did not occur during the coating process with 44% utilization of the thermal spray powder. The thus obtained thermal spray coating layer was subjected to the measurement of surface roughness $R_{max}$ according to the method specified in JIS B0601 to find a value of 35 μm.

EXAMPLE 8

An aqueous slurry of ytterbium oxide particles was prepared by dispersing 4 kg of ytterbium oxide particles having an average particle diameter of 1.2 μm and containing 0.5 pp, or less of iron impurity as $Fe_2O_3$ in an aqueous solution of 15 g of hydroxypropylcellulose dissolved in 16 liters of pure water under agitation. The aqueous slurry was subjected to granulation of ytterbium oxide particles in a spray granulator into granules of a globular particle configuration which were calcined in air at 1500° C. for 2 hours to give globular granules usable as a thermal spray powder.

The thus obtained thermal spray powder was subjected to the measurement of the $D_{90}$ value to find a value of 46 μm. The powder had a bulk density of 1.3 $g/cm^3$, BET specific surface area of 1.8 $m^2/g$, cumulative pore volume of 0.23 $cm^3/g$ for the pores having a pore radius not exceeding 1 μm and aspect ratio of granules of 1.07.

Impurities in the powder were determined by the ICP spectrophotometric analysis for iron and calcium and by atomic absorption spectrophotometric analysis for sodium to find 1 ppm of $Fe_2O_3$, 3 ppm of CaO and 4 ppm of $Na_2O$.

A thermal spray coating layer having a thickness of 200 μm was formed on a plate of an aluminum alloy with this thermal spray powder by the method of reduced-pressure plasma spray fusion using a gaseous mixture of argon and hydrogen. Clogging of the thermal spray nozzle did not occur during the coating process with 45% utilization of the thermal spray powder. The thus obtained thermal spray coating layer was subjected to the measurement of surface roughness $R_{max}$ to find a value of 41 μm.

EXAMPLE 9

An aqueous slurry of yttrium oxide particles was prepared by dispersing 2 kg of yttrium oxide particles having an average particle diameter of 0.9 μm and containing 0.5 pp, or less of iron impurity as $Fe_2O_3$ in an aqueous solution of 15 g of carboxymethylcellulose dissolved in 18 liters of pure water under agitation. The aqueous slurry was subjected to granulation of ytterbium oxide particles in a spray granulator into granules of a globular particle configuration which were calcined in air at 1650° C. for 2 hours to give globular granules usable as a thermal spray powder.

The thus obtained thermal spray powder was subjected to the measurement of the $D_{90}$ value to find a value of 28 μm. The powder had a bulk density of 1.1 $g/cm^3$, BET specific surface area of 1.2 $m^2/g$, cumulative pore volume of 0.09 $cm^3/g$ for the pores having a pore radius not exceeding 1 μm and aspect ratio of granules of 1.03.

Impurities in the powder were determined by the ICP spectrophotometric analysis for iron and calcium and by atomic absorption spectrophotometric analysis for sodium to find 3 ppm of $Fe_2O_3$, 3 ppm of CaO and 4 ppm of $Na_2O$.

A thermal spray coating layer having a thickness of 200 μm was formed on a plate of an aluminum alloy with this thermal spray powder by the method of reduced-pressure plasma spray fusion using a gaseous mixture of argon and hydrogen. Clogging of the thermal spray nozzle did not occur during the coating process with 45% utilization of the thermal spray powder. The thus obtained thermal spray coating layer was subjected to the measurement of surface roughness $R_{max}$ to find a value of 26 μm.

COMPARATIVE EXAMPLE 7

An aqueous slurry of yttrium oxide particles was prepared by dispersing 10 kg of yttrium oxide particles having an average particle diameter of 1.1 μm and containing 0.5 pp, or less of iron impurity as $Fe_2O_3$ in an aqueous solution of 15 g of polyvinyl alcohol dissolved in 10 liters of pure water under agitation. The aqueous slurry was subjected to granulation of ytterbium oxide particles in a spray granulator into granules of a globular particle configuration which were calcined in air at 1600° C. for 2 hours to give globular granules usable as a thermal spray powder.

The thus obtained thermal spray powder was subjected to the measurement of the $D_{90}$ value to find a value of 94 μm. The powder had a bulk density of 1.1 g/cm$^3$, BET specific surface area of 1.4 m$^2$/g, cumulative pore volume of 0.21 cm$^3$/g for the pores having a pore radius not exceeding 1 μm and aspect ratio of granules of 1.02.

Impurities in the powder were determined by the ICP spectrophotometric analysis for iron and calcium and by atomic absorption spectrophotometric analysis for sodium to find 3 ppm of $Fe_2O_3$, 2 ppm of CaO and 5 ppm of $Na_2O$.

A thermal spray coating layer having a thickness of 205 μm was formed on a plate of an aluminum alloy with this thermal spray powder by the method of reduced-pressure plasma spray fusion using a gaseous mixture of argon and hydrogen. Clogging of the thermal spray nozzle did not occur during the coating process with 48% utilization of the thermal spray powder. The thus obtained thermal spray coating layer was subjected to the measurement of surface roughness $R_{max}$ to find a value of 88 μm.

COMPARATIVE EXAMPLE 8

A powder of yttrium oxide for use as a thermal spray powder was prepared by crushing and pulverizing a block of yttrium oxide obtained by melting a yttrium oxide powder and solidifying the melt followed by particle size classification.

The thus obtained thermal spray powder was subjected to the measurement of the $D_{90}$ value to find a value of 74 μm. The powder had a bulk density of 2.1 g/cm$^3$, BET specific surface area of 0.1 m$^2$/g, cumulative pore volume of 0.0055 cm$^3$/g for the pores having a pore radius not exceeding 1 μm and aspect ratio of particles of 3.5.

Impurities in the powder were determined by the ICP spectrophotometric analysis for iron and calcium and by atomic absorption spectrophotometric analysis for sodium to find 55 ppm of $Fe_2O_3$, 40 ppm of CaO and 10 ppm of $Na_2O$.

A thermal spray coating layer having a thickness of 190 μm was formed on a plate of an aluminum alloy with this thermal spray powder by the method of reduced-pressure plasma spray fusion using a gaseous mixture of argon and hydrogen. The thus obtained thermal spray coating layer was subjected to the measurement of surface roughness $R_{max}$ to find a value of 69 μm.

To summarize, the thermal spray powders prepared in Examples 7 to 9 each have a $D_{90}$ value not exceeding 60 μm, bulk density not exceeding 1.6 g/cm$^3$, cumulative pore volume of at least 0.02 cm$^3$/g and aspect ratio not exceeding 2 so that the powder exhibits excellent flowability in thermal spray coating without causing a trouble due to clogging of the thermal spray nozzles and fusion of the granules in the plasma flame is so complete that the thermal spray coating layer is ensured to have good smoothness of the surface. In addition, the outstandingly low content of impurities is a factor advantageously influencing the corrosion resistance of the coating layer which is imparted with high corrosion resistance against plasma etching with reduced occurrence of particulate matters. The very high purity of the thermal spray coating layer is very desirable when the coated article is a part or member of an instrument or machine for processing of semiconductor devices or liquid crystal display devices.

In contrast thereto, the thermal spray powder prepared in Comparative Example 7 has a large $D_{90}$ value of 94 μm resulting in a large surface roughness value of the thermal spray coating layer which necessarily leads to occurrence of a particulate matter in the process of plasma etching on the surface having a so large surface roughness value. This problem is still more serious with the powder prepared in Comparative Example 8 so that the thermal spray coating layer formed therewith and having a large surface roughness value exhibits speckles which eventually lead to localized corrosion of the coating layer in the process of plasma etching.

Furthermore, the impurity level in the thermal spray coating layers prepared in Examples 7 to 9 is so low that the coated articles are suitable for use as a member or part of the apparatus for processing of electronic devices not to cause contamination of the materials under processing. The coated articles have very small surface roughness and are highly corrosion resistant against halogen-containing etching gaseous atmosphere to be useful in the process of plasma etching since a large value of the surface roughness is a factor to cause occurrence of particulate matter in plasma etching resulting in contamination of the materials under processing.

What is claimed is:

1. A method for the formation of a coating layer highly resistant against an atmosphere of a halogen-containing plasma from a rare earth oxide or a rare earth-based composite oxide which comprises the step of:

spraying, at the surface of a substrate, particles which are carried by a flame, which particles are particles of the rare earth oxide or the rare earth-based composite oxide, which contain iron as an impurity in an amount not exceeding 5 ppm by weight calculated as oxide, said particles having an average particle diameter in the range from 5 to 80 μm, with a dispersion in the range from 0.1 to 0.7 and a specific surface area in the range from 1 to 5 m$^2$/g.

2. The method for the formation of a coating layer as claimed in claims 1 in which the flame carrying the particles is a plasma flame.

3. The method for the formation of a coating layer as claimed in claim 2 in which the plasma flame is a reduced-pressure plasma flame.

4. The method for the formation of a coating layer as claimed in claim 1 in which the substrate is made from aluminum metal or an aluminum-based alloy.

5. The method for the formation of a coating layer as claimed in claim 1 in which spraying of the particles is continued until the coating layer on the substrate surface has a thickness in the range from 50 to 500 μm.

* * * * *